US010767418B2

(12) United States Patent
Moreno Moncada

(10) Patent No.: US 10,767,418 B2
(45) Date of Patent: Sep. 8, 2020

(54) TRIPOD STEPLADDER

(71) Applicant: Louisville Ladder Inc., Louisville, KY (US)

(72) Inventor: Francisco Javier Moreno Moncada, Monterrey (MX)

(73) Assignee: Louisville Ladder Inc., Louisville, KY (US)

( * ) Notice: Subject to any disclaimer, the term of this patent is extended or adjusted under 35 U.S.C. 154(b) by 201 days.

(21) Appl. No.: 16/144,675

(22) Filed: Sep. 27, 2018

(65) Prior Publication Data

US 2020/0102787 A1 Apr. 2, 2020

(51) Int. Cl.

| | |
|---|---|
| ***E06C 7/50*** | (2006.01) |
| ***E06C 1/20*** | (2006.01) |
| ***E06C 1/38*** | (2006.01) |
| *E06C 7/42* | (2006.01) |

(52) U.S. Cl.

CPC ..... *E06C 7/50* (2013.01); *E06C 1/20* (2013.01); *E06C 1/382* (2013.01); *E06C 7/423* (2013.01)

(58) Field of Classification Search

CPC ..... E06C 1/382; E06C 7/50; E06C 7/423
See application file for complete search history.

(56) References Cited

U.S. PATENT DOCUMENTS 767,257 A * 8/1904 Banks ..... E06C 1/20 182/169
785,277 A * 3/1905 Smith ..... E06C 1/20 182/169
1,067,170 A * 7/1913 Hewett ..... E06C 1/20 182/169
1,139,990 A * 5/1915 Merrill ..... E06C 1/20 182/169
1,217,713 A * 2/1917 Cotter ..... E06C 1/20 182/169
1,377,579 A * 5/1921 Hedden ..... E06C 1/20 182/170
1,783,616 A * 12/1930 Hachmuth ..... E06C 1/20 182/170
2,440,831 A * 5/1948 Pease ..... E06C 1/20 182/175
2,500,333 A * 3/1950 Young ..... E06C 1/20 182/169
3,447,632 A * 6/1969 Boyd ..... E06C 1/382 182/116
3,472,339 A * 10/1969 Crisogono ..... E06C 7/14 182/116
3,474,883 A * 10/1969 Weis ..... E06C 1/20 182/169

(Continued)

*Primary Examiner* — Colleen M Chavchavadze

(74) *Attorney, Agent, or Firm* — Egbert, McDaniel & Swartz PLLC

(57) ABSTRACT

A stepladder assembly has a front section with a pair of side rails and a plurality of steps extending between the pair of side rails, a back section having a rail, and a frame pivotally connected or interconnected to the front section. The frame has a collar receiving an upper end of the rail of the back section therein. A ladder top is affixed to an upper end of the front section. The frame is pivotally affixed to the ladder top. The frame has a horizontal member positioned above the collar, and first and second side members extending from the collar to opposite ends of the horizontal member.

15 Claims, 4 Drawing Sheets

(56) References Cited

U.S. PATENT DOCUMENTS

| | | | | | |
|---|---|---|---|---|---|
| 4,600,080 | A * | 7/1986 | Forrester | E06C 1/20 | 182/124 |
| 4,618,027 | A * | 10/1986 | Piretti | E06C 1/005 | 182/160 |
| 6,874,598 | B1 * | 4/2005 | Baker | E06C 1/38 | 182/165 |
| 9,663,991 | B2 * | 5/2017 | Zorney | E06C 7/08 | |

* cited by examiner

TRIPOD STEPLADDER

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to stepladders. More particularly, the present invention relates to tripod or three-legged stepladders. More particularly, the present invention relates to frames that secure the single leg of the tripod stepladder to the front section of the stepladder.

2. Description of Related Art Including Information Disclosed Under 37 CFR 1.97 and 37 CFR 1.98.

Stepladders allow an individual to climb to a height for manipulating objects or performing work where the latter is essentially pre-standing. In other words, the ladder depends solely upon its construction and erection to ensure its stability, in comparison to standard extension ladders which are braced against a structure to be climbed.

A typical stepladder is designed to be folded into a convenient size for storage and carrying. This requirement that the stepladder be portable is a further constraint on the weight of the ladder. Thus, a typical stepladder will be found to weigh thirty pounds or less in order to ensure that it may be easily handled. It is typically designed to be folded into an essentially flat package.

The classic stepladder has a front ladder portion having two vertically ascending parallel members with angled steps periodically interposed therebetween to permit climbing. At an upper end, a rear leg section is pivotally attached. A folding brace member is used to extend the ladder to an expanded climb-aboard configuration.

The stability of the ladder is totally dependent upon the user's movement upon the ladder during use. The requirement that the ladder be portable tends to reduce the static weight of the ladder to as low of a level as is consistent with minimal structural strength. When considering that a typical user will weigh 150 pounds or more, practically all of the weight involved in the dynamic couple of the stepladder and user will be concentrated in the user.

There are two forces that affect the stability of the ladder. The first is static stability. In other words, static stability extending downward from the combined center-of-gravity of the user and the ladder to a point outside the area demarked by the legs of the ladder. This is a classic condition of static instability. Since the ladder has such little weight relative to the user, the actual location of the center-of=ravity of the user pre-determines the stability. A second dynamic condition relating to stability exist because the user at the top of the ladder, normal conditions, is exerting a reactive force across a moment couple essentially equal to the distance from the foot of the ladder to the point of contact with the user. This can often be a six-foot moment couple. Since this is a dynamic condition, induced by the motions of the user during work, the resisting couple is the weight of the ladder and the user.

The motion of the user also creates a torsional stress, twisting the ladder. The torsional stresses, in the form of twisting about the vertical axis of the ladder, is the most common cause of dynamic unloading of one or more ladder legs in response the user's motion. The result is an alternative loading and unloading of the legs of the ladder which produces an effect called "walking" where the ladder moves or creeps along the floor as the individual shifts his or her weight.

Since tripods are known to be inherently stable structures, especially on uneven ground, various attempts have been made to create stepladders of a triangular structure with an independent rear leg. In the past, various patents have issued with respect to said tripod stepladders. For example, U.S. Pat. No. 2,440,831, issued on May 4, 1948 to L. R. Pease, teaches a tripod stepladder having rails, step rungs, and a platform at the upper end of the rails. There is at least one brace leg pivotally connected about an axis adjacent to the platform. A crank arm is journaled onto the rails under the platform and movable into engagement with the brace leg to urge the leg rearwardly.

U.S. Pat. No. 3,356,180, issued on Dec. 5, 1967 to R. D. Parry, discloses a tripod stepladder having a pair of side posts, at least two steps to disposed between the side posts a rest bar in a rowwith the side posts and having a substantially inverted U-shaped configuration, a tripod leg pivotally connected at one end to the rest bar, and a standing platform disposed substantially below the rest bar and pivotally connected to the uppermost step at one end. The platform includes a rigid structure defining an aperture at the other end of the platform. The aperture is positioned so that the tripod leg passes there through.

U.S. Pat. No. 4,249,637, issued on Feb. 10, 1981 to T. A. Glasgow, teaches a tripod stepladder that includes rigid stiles having steps and a platform secured thereto. A hinge plate is pivoted to the platform and to a pair of legs to permit the legs to pivot as a unit towards and away from the stiles. The legs pivot relative to the hinge plate toward and away from each other to an folded tripod configuration.

U.S. Pat. No. 4,600,080, issued on Jul. 15, 1986 the C. R. Forrester, shows a three-legged stepladder in which a brace includes a sleeve or a collar that slides up and down the third or rear leg as the ladder is folded and unfolded. A pail shelf is pivotally attached to the third leg and locks the ladder in the open position.

U.S. Pat. No. 4,754,845, issued on Jul. 5, 1988 to W. H. Baker, describes a stepladder having a rigidified step section, a strengthened upper platform, and a pair of independently articulated angled rear legs that are supported by a pair of rigid pivoting supports. The angle of extension of the rear leg creates, in conjunction with the front step section of the stepladder, an essentially equilateral, triangular footprint.

U.S. Pat. No. 6,206,139, issued on Mar. 27, 2001 to R. C. Bogart, provides a folding tripod ladder having extendable legs. The ladder includes a top step, a pair of leg assemblies mounted to the top step, and a step assembly mounted to the top step. The leg assembly and the step assembly pivot from a closed position in which the leg assemblies and the step assembly extend vertically downwardly from the top step to an angular position in which the leg assemblies and the step assembly are angularly displaced from vertical and oriented along radial axes positioned 120° from one another in a tripod configuration. Each leg assembly and step assembly are locked in the selected angular position.

U.S. Pat. No. 6,874,598, issued on Apr. 5, 2005 to W. H. Baker, teaches a stepladder of a tripod structure with an actuating mechanism that extends the rear legs in the front step assembly in a coordinated manner to assume the tripod footprint. The actuating mechanism includes a vertical center post. A sliding collar journaled on the center post coordinates the extension and retraction of the rear legs and step assembly. An A-brace extends and retracts the step assembly.

U.S. Pat. No. 7,255,198, issued on Aug. 14 2007 to J. A. Lo, discloses a tripod extension stepladder having a ladder portion having a pair of ladder side rails, and a support portion that includes a pair of angularly disposed telescoping legs. The telescoping support legs are interconnected to each other and to the ladder side rails by lockable rigid spanner arms. When in use, the spanner arms are locked in an open position to form a tripod formation between the rails while additionally limiting the angle of a spread between the ladder portion and the support legs.

U.S. Patent Application Publication No. 2015/0345219, published on Dec. 3, 2015 to Aoi et al., teaches a stepladder provided with a coupling frame in the shape of an equilateral triangle. There is a front support, a rear right support, a rear left support, and spread stoppers for stopping the front support, the rear right support and the rear left support from spreading.

It is an object of the present invention provide a tripod stepladder that is very robust.

It is another object of the present invention provide a tripod stepladder that is very durable.

It is another object of the present invention to provide a tripod stepladder that is easy to assemble.

It is another object of the present invention to provide a tripod stepladder that has a minimal number of components.

It is a further object of the present invention to provide a tripod stepladder that prevents a twisting motion to the back leg.

It is another object of the present invention to provide a tripod stepladder that withstands impact forces.

It is another object of the present invention to provide a tripod stepladder that reduces torsional effects to the front section.

It is still another object of the present invention to provide a tripod stepladder that distributes loads over a wider area and between the front section and the rear leg.

It is still another object of the present invention to provide a tripod stepladder which is relatively inexpensive.

It is still further object of the present invention to provide a tripod stepladder which provides enhanced stability while minimizing the weight of the stepladder.

These and other objects and advantages of the present invention will become apparent from a reading of the attached specification and appended claims.

BRIEF SUMMARY OF THE INVENTION

The present invention is a stepladder assembly that comprises a front section having of a pair of side rails with a plurality of steps extending between the pair of side rails, a back section having a rail, and a frame pivotally connected or interconnected to the front section. The frame has a collar that receives an upper end of the back section therein.

The stepladder assembly of the present invention further includes a ladder top affixed to an upper end of the front section. The frame is pivotally affixed to the ladder top. The ladder top has a top surface extending over the upper end of the front section and over the upper end of the back section. The ladder top has a pair of sides extending downwardly from the top surface. The frame is pivotally mounted to the pair of sides.

The rail of the tripod stepladder assembly of the present invention is a square tubular. The collar has a square cross-section. An interior of the collar is in surface-to-surface relation with an exterior of the rail.

The frame of the tripod stepladder assembly of the present invention has a horizontal member positioned above the collar, a first side member extending from the collar to one end of the horizontal member, and a second side member extending from the collar to an opposite end of the horizontal member. The first side member has a lower end affixed to one side of the collar at a bottom thereof. The second side member has a lower end affixed to an opposite side of the collar at the bottom thereof. A first cross member has one end affixed to an end of the horizontal member or to an upper end of the first side member and an opposite end affixed to one side of the collar. A second cross member has one end affixed to the opposite end of the horizontal member or to an upper end of the second side member and an opposite end affixed to an opposite side of the collar. A third cross member has one end affixed to the mid-portion of the first side member and an opposite end affixed to an upper end of the collar. A fourth cross member has one end affixed to a mid-portion of the second side member and an opposite end affixed to the upper end of the collar. The opposite end of the first cross member is affixed to a central area of one side of the collar. The opposite end of the second cross member is affixed to a central area of the opposite side of the collar. The collar extends from a bottom of the first and second side members to the horizontal member. A plurality of fasteners are affixed to the collar into the upper end of the rail of the back section. The frame has a first flange extending upwardly from one end of the horizontal member and a second flange extending upwardly from an opposite end of the horizontal member. The first and second flanges are pivotally affixed respectively to the pair of sides of the ladder top.

A hinge or brace has one end affixed to a mid-portion of the front section and to a mid-portion of the back section. The hinge or brace limits a pivotal movement of the back section with respect to the front section.

In the present invention, the pair of side rails of the front section are angled with respect to each other such that a width of a bottom of the front section is wider than the width of a top of the front section. The frame is integrally formed of a polymeric material. The rail is a single rail.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
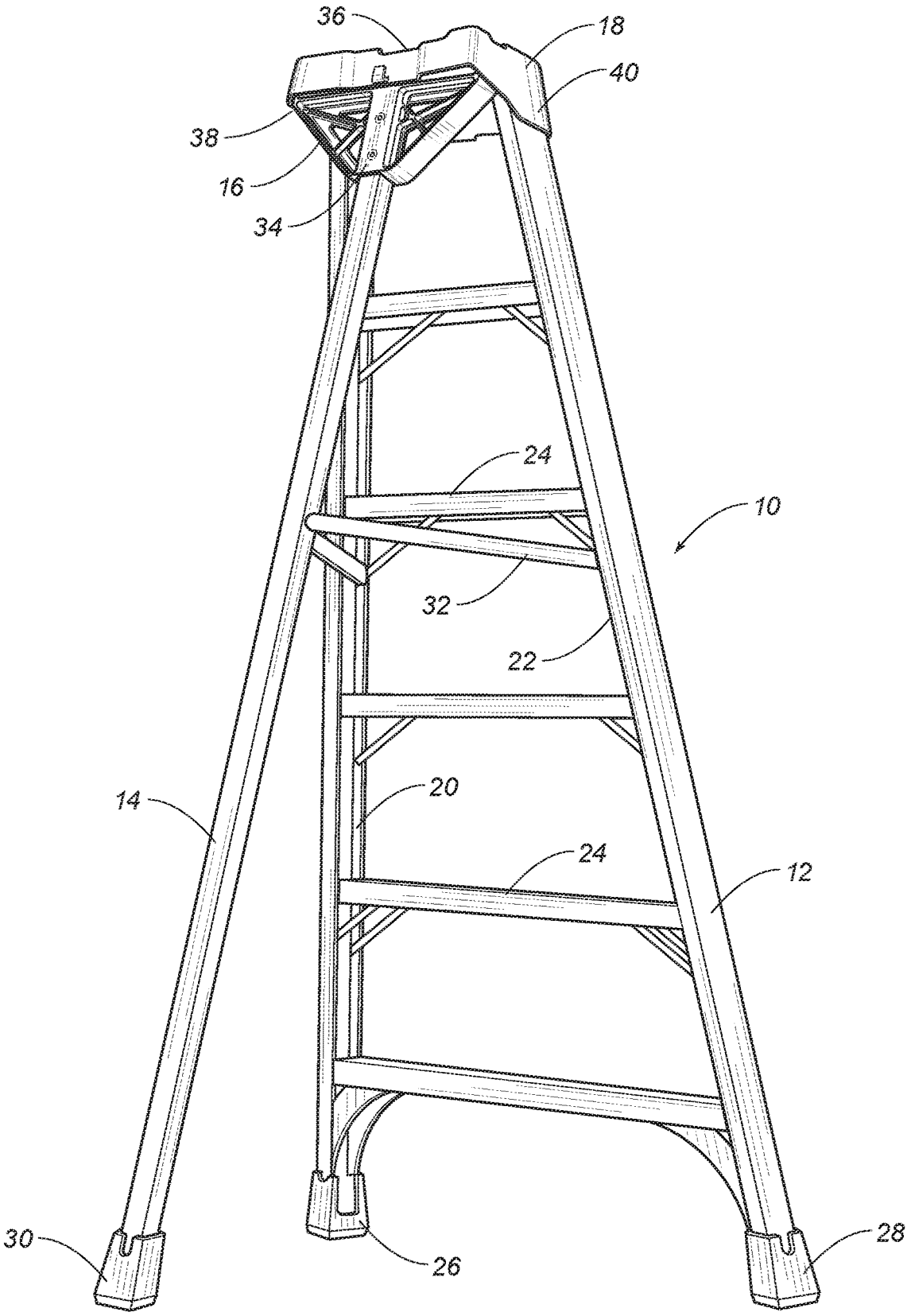
FIG. 1 is a perspective view of the tripod stepladder in accordance with the preferred embodiment the present invention.

Referring to FIG. 1, there is shown the tripod stepladder assembly 10 in accordance with the teachings of the present invention. The tripod stepladder assembly has a front section 12, a back section 14, a frame 16 and a ladder top 18. The front section 12 has a first side rail 20 and a second side rail 22. A plurality of steps 24 extend between the first side rail 20 and the second side rail 22. The first side rail 20 and the second side rail 20 are angled with respect to each other so such that a width of the front section 12 at the bottom is greater than a width of the front section 12 at the ladder top 18. As such, each of the plurality of steps 24 will have a decreasing length from the bottom to the top of the front section 12. Foot 26 is affixed to the bottom of the first side rail 20. Foot 28 is affixed to the bottom of the second side rail 12. Feet 26 and 28 are of a polymeric material and provide additional stability to the bottom of the front section 12.

The back section 14 is a single rail. A foot 30 is affixed to the bottom end of the back section 14. The back section 14 is pivotally mounted so as to be movable into a position generally parallel to the front section 12 and a position angularly disposed away from the front section 12. A hinge or brace 32 is affixed to the front section 12 and to the back section 14 so as to limit the amount of angular movement between the front section 12 and the back section 14. Hinge or brace 32 also provides additional structural integrity to the tripod stepladder 10 of the present invention.

The frame 16 has a generally V-shaped configuration. In particular, there is a collar 34 (to be described hereinafter) that receives the upper end of the back section 14. A pair of side members extend upwardly from the collar 34 so as to be pivotally mounted to the ladder top 18.

The ladder top 18 is affixed to the upper end of the front section 12 and receives the upper end of the frame 16 therein. The ladder top 18 has a top surface 36 and a pair of sides 38 and 40 extending downwardly therefrom. The first leg 20 is affixed to the side 38 of the ladder top 18. Side rail 22 is affixed to the side 40 of the ladder top 18. Similarly, the upper ends of the frame 16 will be pivotally secured to the sides 38 and 40.

In FIG. 1, is important to note that the collar 34 receives a substantial portion of the upper end of the back section 14. The side members are joined to the collar 34 at the bottom thereof. Any forces imparted to the back section 14 are distributed over a wide area to the ladder top 36. Similarly, this strong joinder between the frame 16 and the back section 14 serves to reduce torsional effects caused by movement on the front section 12. The coupling of the collar 34 to the ladder top 18 and to the front section 12 provides strong forces against this torsional movement over the entire area of the front section 12. Additionally, the wide base of the front section 12 serves to distribute further torsional forces to the side rails 20 and 22 adjacent to the bottom of the front section 12. The use of the collar 34 on the upper end of the back section 14 provides a secure surface-to-surface contact between the collar 34 and the exterior of the upper end of the back section 14. This resists any damage to the fasteners that secure the back section 14 to the frame 16. Over time, the structural connection between the frame 16 and the back section 14 will not weaken or loosen because of this collared configuration. Importantly, since the rail of the back section 14 is a single rail and formed of a square tubular, this serves to further reduce any potential bending of the back section 14. Since the collar 34 is also of a square cross-section, the engagement between the back section 14 of the collar 34 is very secure. Twisting effects between the collar 34 and the back section 14 are avoided by virtue of this square-in-square relationship. To the extent that the back section 34 receives side forces which would otherwise tend to bend the back section 14, the substantial portion of the upper end of the back section 14 received within the collar 34 will strongly resist any such bending along the length of the square tubular of the back section 14. Since the frame 16 can be formed of a polymeric material, the weight of the frame 16 is minimal, the expense for manufacturing the frame 16 is minimal, and the assembly of the frame 16 to the back section 14 is extremely easy.

Figure 2:
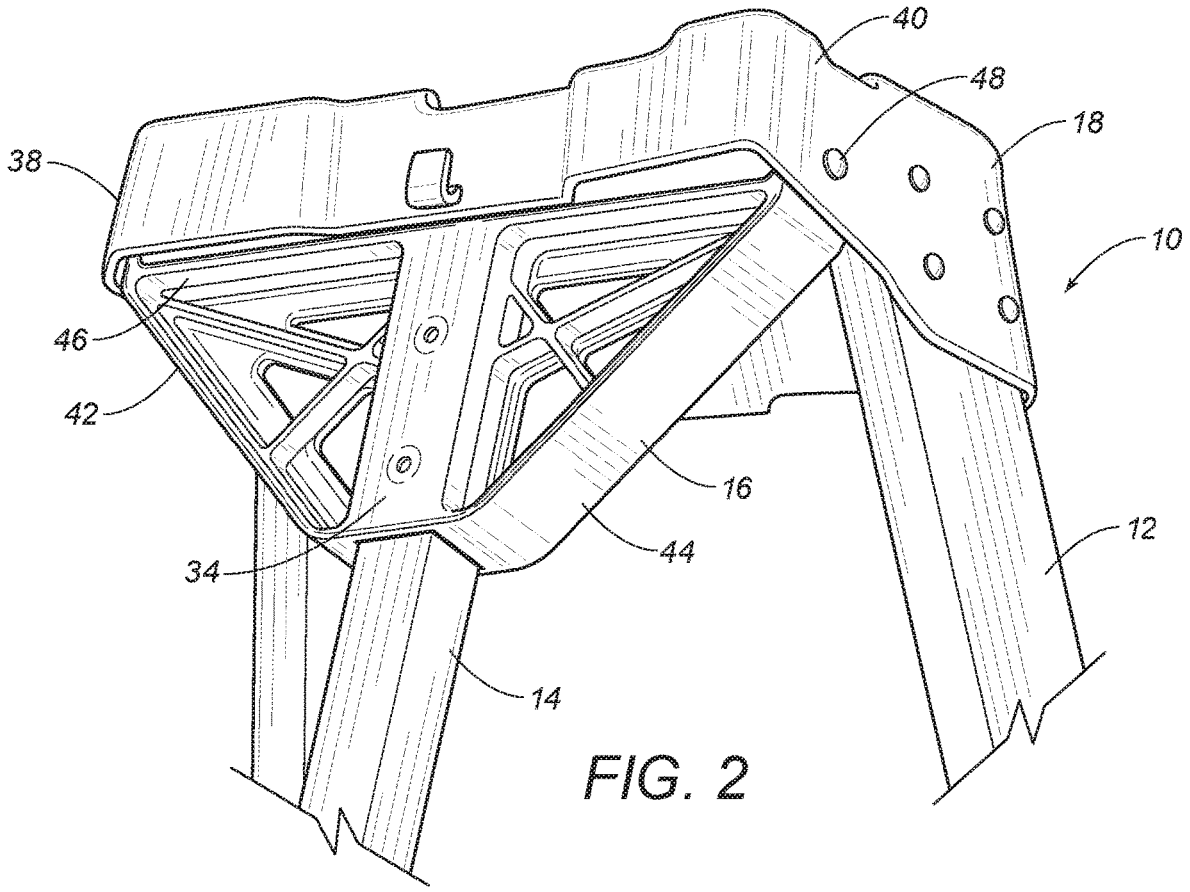
FIG. 2 is a perspective close-up view of the upper end of the tripod stepladder of the present invention.

FIG. 2 specifically shows the ladder top 18 as secured to the front section 12 and to the back section 14 through the use of the frame 16. The frame 16 has the collar 34 receiving the upper end of the back section 14 therein. Fasteners extend through the collar 34 and through the upper end of the back section 14 so as to affix the upper end of the back section 14 permanently within the collar 34. Side members 42 and 44 extend upwardly from the bottom of the collar 34 at an angle. A horizontal member 46 is formed with or affixed to the upper end of the side members 42 and 44. Each of the side members 42 and 44 has an either a T-shaped or L-shaped configuration. This L-shaped or T-shaped configuration further enhances the structural strength of the side members 42 and 44 and the horizontal member 46 so as to resist any bending motions associated with the use of the tripod stepladder assembly 10.

FIG. 2 shows that there is a pivot pin 48 which pivotally connects the frame 16 to the ladder top 18 at the side 40. Another pin will connect the opposite side of the frame 16 to the side 38 of the ladder top 18.

Figure 3:
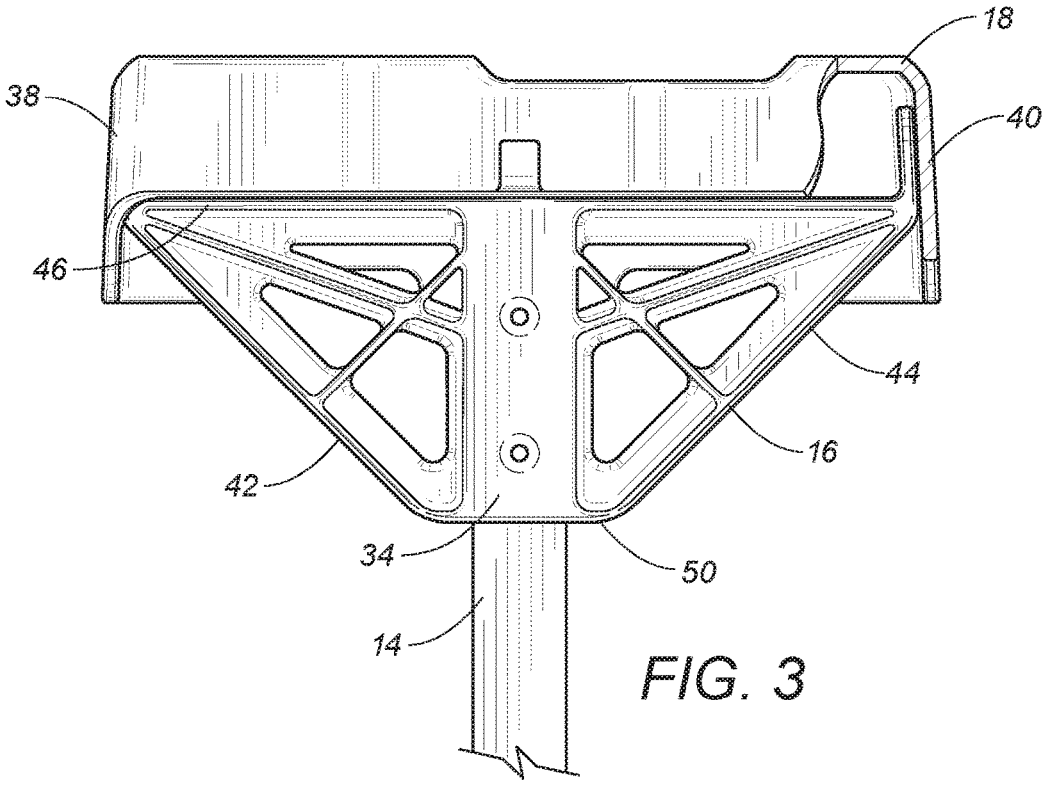
FIG. 3 is a rearward view of the upper end of the tripod stepladder assembly of the present invention.

FIG. 3 illustrates how the rail of the back section 14 is received within the interior of the collar 34. It can be seen that the collar 34 extends all the way from the bottom 50 of the frame 16 to the horizontal member 46 at the top of the frame 16. As such, substantial portion of the length of the back section 14 is received within the collar 34. Ultimately, the structural strength of the T-shaped or L-shaped horizontal member 16 will maintain the collar 34 in a fixed and rigid position. The side members 42 and 44 resist deflection of the collar 34 and distribute any forces to the horizontal member 46 and to the sides 38 and 40 of the ladder top 18. As will be described hereinafter, certain cross members extend within the interior of the frame 16 so as to further distribute forces and resist any bending moment of the collar 34 caused by a shifting of weight on the front section 12 or by an undesired force applied to the rear section 14.

Figure 4:
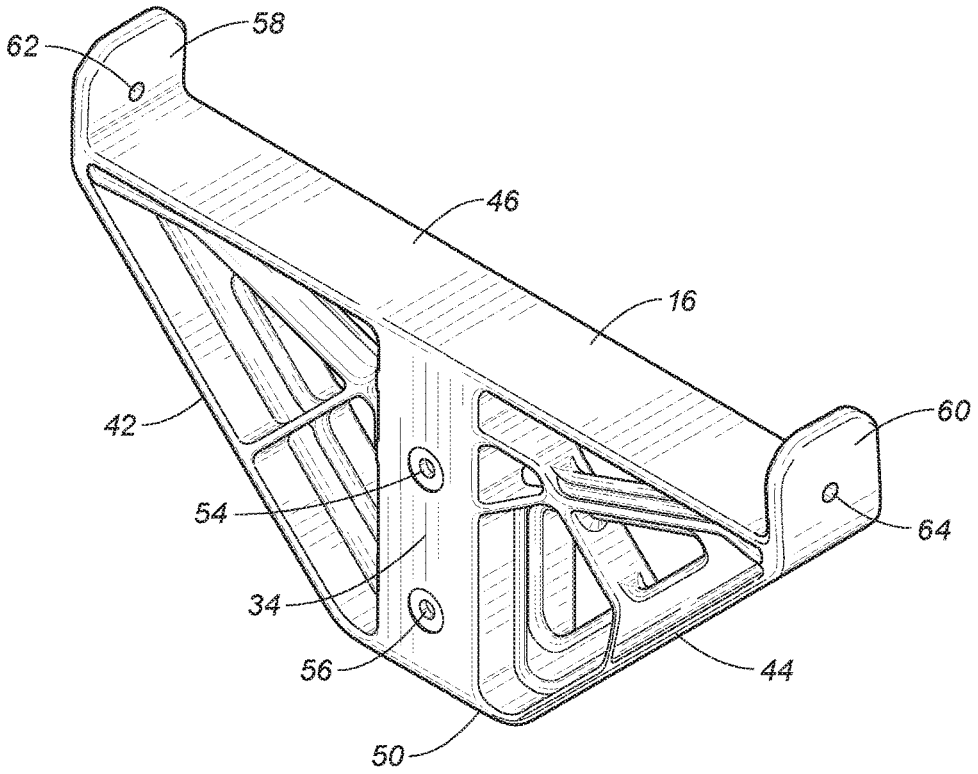
FIG. 4 is an upper rearward perspective view of the frame of the tripod stepladder of the present invention.

FIG. 4 is a detailed view of the frame 16 in the tripod stepladder assembly 10 of the present invention. In FIG. 4, it can be seen that the collar 34 extends from the bottom 50 of the frame 16 all the way to the horizontal member 46. Side members 42 and 44 extend outwardly from the bottom of the collar 34 at an approximately 45° angle upwardly to the opposite ends, respectively, of the horizontal member 46. Holes 54 and 56 are formed in the wall of the collar 34 so as to allow fasteners to be received therein so as to secure the square back section 14 within the interior of the square collar 34. A first flange 58 extends upwardly from one end of the horizontal member 46 and upwardly from an upper end of the side member 42. Another flange 60 extends upwardly from the opposite end of the horizontal member 46 and from the upper end of the side member 44. Flanges 58 and 60 are respectively secured to the sides 38 and 40 of the ladder top 18. The flat outer surfaces of the flanges 58 and 60 against the flat inner surfaces of the sides 38 and 40 of the ladder top 18 further serves to distribute forces over a wider area. A hole 62 is provided on flange 58 and a hole 64 is provided on flange 60. Holes 62 and 64 are configured to receive pivot pins therethrough so as to allow the frame 16 to pivot with respect to the ladder top 18.

In FIG. 4, it can be seen that the side members 42 and 44 each have a T-shaped configuration. As such, there is a center strut that enhances the structural integrity of each of the side members 42 and 44 and further resists deflection.

Figure 5:
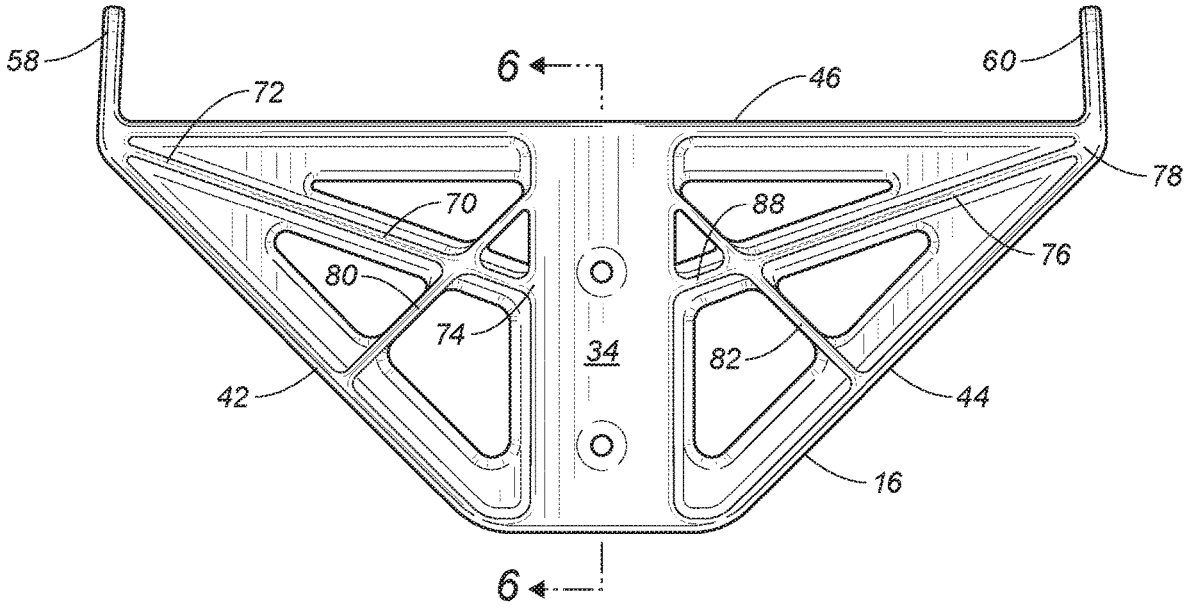
FIG. 5 is a rearward view of the frame of the tripod stepladder assembly of the present invention.

FIG. 5, in particular, shows the various cross members that are located within the interior of the frame 16 in a location between the side member 42 and the collar 34 and between the side member 44 and the collar 34. A first cross member 70 has an end 72 that is affixed to an end of the horizontal member 46 or to an upper end of the side member 42. An opposite end 74 is affixed to the collar 34. In particular, this opposite end 74 is affixed or formed with a mid-portion of the collar 34. The end 72 of the first cross member 70 will be structurally enhanced by being located at the intersection of the horizontal member 46 and the first side member 42, along with the flange 58. A second cross member 76 has an end 78 affixed to or formed with the opposite end of the horizontal member 46 and/or at an upper end of the second side member 44. An opposite end 88 is affixed to an opposite side of the collar 34 from that of the first cross member 70. The end 88 is actually placed at a mid-portion of the collar 34. The end 78 will be located beneath the flange 60.

A third cross member 80 has one end affixed to a mid-portion of the first side member 42 and an opposite end affixed to an upper end of the collar 34. A fourth cross member 82 has one end affixed to a mid-portion of the second side member 44 and an opposite end affixed to an upper end of the collar 34.

In FIG. 5, it can be seen that each of the side members 42 and 44 and each of the cross members 70 and 76 is of a T-shaped configuration. An L-shaped configuration can be used alternatively. Each of the cross members 80 and 82 is generally of a planar configuration. The intersection of the cross members 80 and 82 with the cross members 70 and 76 further distributes forces from the collar 34 along the side rails 42 or toward the horizontal member 46 in a strong connection area adjacent to the flanges 58 and 60.

Figure 6:
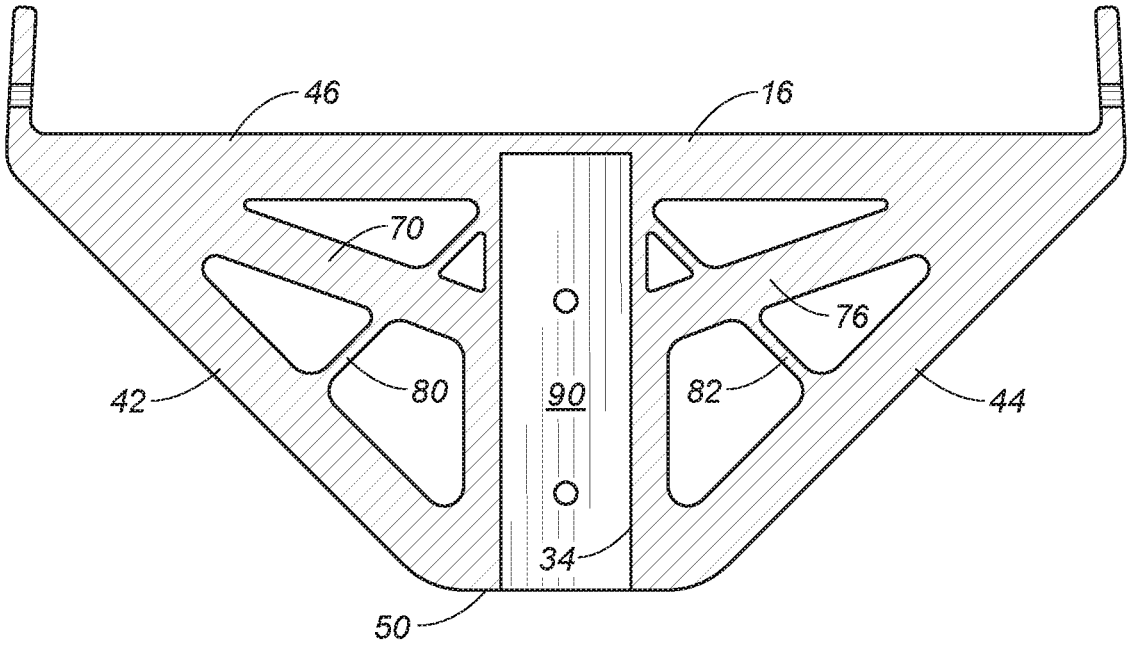
FIG. 6 is a cross-sectional view of the frame of the tripod stepladder assembly of the present invention as taken across line 6-6 of FIG. 5.

FIG. 6 is a cross-sectional view of the frame 16 of FIG. 5 as taken across line 6-6 of FIG. 5. In particular, the collar 34 has a generally rectangular or square interior 90. The side members 42 and 44 extend upwardly from the bottom 50 of the frame 16. The horizontal member 46 extends entirely across the top of the frame 16. FIG. 6 also shows the orientation of the first cross member 70, the second cross member 76, the third cross member 80 and the fourth cross member 82. In the cross-sectional view of FIG. 6, each of the cross members is particularly illustrated. As such, the distribution of forces actually crosses a very wide surface area of the frame 16. The open area shown in FIG. 6 between the various cross members further enhances the flexibility of the frame 16 while resisting forces applied thereto.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A stepladder assembly comprising:

a front section having a pair of side rails with a plurality of steps extending between said plurality of side rails;

a back section having a rail; and a frame pivotally connected or interconnected to said front section, said frame having a collar receiving an upper end of said back section therein, said frame comprising:

a horizontal member positioned above said collar;

a first side member extending from said collar to one end of said horizintal member;

a second side member extending from said collar to an opposite end of said horizontal member, said first side member having a lower end affixed to one side of said collar at a bottom end thereof, said second side member having a lower end affixed to an opposite side of said collar at the bottom end thereof;

a first cross member having one end affixed to an end of said horizontal member or to an upper end of said first side member and an opposite end affixed to one end of said collar;

a second cross member having one end affixed to an opposite end of said horizontal member or to an upper end of said second side member and an opposite end affixed to an opposite side of said collar;

a third side member having one end affixed to a mid-portion of said first side member and an opposite end affixed to an upper end of said collar; and a fourth cross member having one end affixed to a mid-portion of said second side member and an opposite end affixed to the upper end of said collar.

2. The stepladder assembly of claim 1, further comprising:

a ladder top affixed to an upper end of said front section, said frame being pivotally affixed to said ladder top.

3. The stepladder assembly of claim 2, said ladder top having a top surface extending over the upper end of said front section and over the upper end of said back section.

4. The stepladder assembly of claim 3, said ladder top having a pair of sides extending downwardly from said top surface, said frame being pivotally mounted to said pair of sides.

5. The stepladder assembly of claim 1, the rail of said back section being a square tubular, said collar having a square cross-section, an interior of said collar being in surface-to-surface contact with an exterior of the rail of said back section.

6. The stepladder assembly of claim 1, said opposite end of said first cross member affixed to a central area of the one side of said collar, said opposite end of said second cross member affixed to a central area of the opposite side of said collar, each of the first and second cross members having a T-shaped cross section.

7. The stepladder assembly of claim 1, said collar extending from the bottom of said first and second side members to said horizontal member.

8. The stepladder assembly of claim 1, further comprising:

a plurality of fasteners affixed to said collar and to the upper end of said back section.

9. The stepladder assembly of claim 1, further comprising:

a hinge having one end affixed to a mid-portion of said front section and to a mid-portion of said back section, said hinge limiting a pivotal movement of said back section with respect to said front section.

10. The stepladder assembly of claim 1, said plurality of side rails of said front section being angled with respect to each other such that a width of a bottom of said front section is wider than a width of a top of said front section.

11. The stepladder assembly of claim 1, said frame being integrally formed of a polymeric material.

12. The stepladder assembly of claim 1, said rail being a single rail.

13. A stepladder assembly comprising:

a front section having a pair of side rails with a plurality of steps extending between said plurality of side rails;

a back section having a rail;

a frame pivotally connected or interconnected to said front section, said frame having a collar receiving an upper end of said back section therein, said frame having a horizontal member positioned above said collar, said frame having a first flange extending upwardly from one end of said horizontal member and a second flange extending upwardly from an opposite end of said horizontal member, a ladder top affixed to an upper end of said front section, said ladder top having a top surface extending over the upper end of said front section and over the upper end of said back section, said ladder top having a pair of sides extending downwardly from said top surface, and said first and second flanges being pivotally affixed respectively to the pair of sides of said ladder top.

14. A stepladder assembly comprising:

a front section having a pair of side rails with a plurality of steps extending between said pair of side rails;

a back section having a single rail;

a ladder top affixed to an upper end of said front section; and a frame pivotally affixed to said ladder top, said back section being affixed to said frame, said frame comprising:

a collar receiving an upper end of said single rail of said back section therein;

a horizintal member positioned above said collar;

a first side member extending from said collar to one end of said horizontal member; and a second side member extending from said collar to an opposite end of said horizontal member, said frame having first flange extending upwardly from one end of said horizontal member and a second flange extending upwardly from an opposite end of said horizontal members, said first and second flanges being pivotally affixed respectively to a pair of sides of said ladder top.

15. The stepladder assembly of claim 14, said frame further comprising:

a first cross member having one end affixed to an end of said horizontal member or to an upper end of said first side member and an opposite end affixed to one side of said collar;

a second cross member having one end affixed to an opposite end of said horizontal member or to an upper end of said first side member and an opposite end affixed to an opposite side of said collar, said first and second cross member having a T-shaped cross section;

a third cross member having one end affixed to a mid-portion of said first side member and an opposite end affixed to an upper end of said collar; and a fourth cross member having one end affixed to a mid-portion of said second side member and an opposite end affixed to the upper end of said collar.

* * * * *